US009758343B2

(12) United States Patent
Helenius

(10) Patent No.: US 9,758,343 B2
(45) Date of Patent: Sep. 12, 2017

(54) ELEVATOR HAVING A ROPE MONITORING ARRANGEMENT AND METHOD FOR CONTROLLING THE ELEVATOR

(71) Applicant: KONE Corporation, Helsinki (FI)

(72) Inventor: Juha Helenius, Vantaa (FI)

(73) Assignee: KONE CORPORATION, Helsinki (FI)

( * ) Notice: Subject to any disclaimer, the term of this patent is extended or adjusted under 35 U.S.C. 154(b) by 0 days.

(21) Appl. No.: 15/139,060

(22) Filed: Apr. 26, 2016

(65) Prior Publication Data

US 2016/0340150 A1 Nov. 24, 2016

(30) Foreign Application Priority Data

May 20, 2015 (EP) ..... 15168287

(51) Int. Cl.
*B66B 5/02* (2006.01)
*B66B 1/30* (2006.01)
(Continued)

(52) U.S. Cl.
CPC ..... *B66B 5/027* (2013.01); *B66B 1/30* (2013.01); *B66B 5/00* (2013.01); *B66B 5/0006* (2013.01);
(Continued)

(58) Field of Classification Search
CPC ... B66B 5/0006; B66B 5/0018; B66B 5/0031; B66B 7/1215; B66B 1/30; B66B 5/027
See application file for complete search history.

(56) References Cited

U.S. PATENT DOCUMENTS 4,995,855 A * 2/1991 Hasebe ..... F16H 55/38 474/167
5,284,457 A 2/1994 Gerstenberger et al.
(Continued)

FOREIGN PATENT DOCUMENTS

CH WO 2014001371 A1 * 1/2014 ..... B66B 5/0031
EP 1 568 646 A2 8/2005

OTHER PUBLICATIONS

EPO, Machine Translation, WO 2014 001 371 A1, Jul. 25, 2016, pp. 1-7.*

*Primary Examiner* — William A Rivera
*Assistant Examiner* — Stefan Kruer
(74) *Attorney, Agent, or Firm* — Birch, Stewart, Kolasch & Birch, LLP

(57) ABSTRACT

An elevator includes first and second elevator units vertically movable in a hoistway and interconnected by at least one belt-shaped hoisting rope. Each of the belt-shaped hoisting ropes is moved and passes around a drive wheel and includes consecutively a first rope section extending between the drive wheel and the first elevator unit, and a second rope section extending between the drive wheel and the second elevator unit. The elevator further includes non-driven cambered diverting wheels, each said first and second rope section being arranged to pass around and rest against a cambered circumferential surface area thereof. A monitoring arrangement monitors displacement of the first and second rope sections of the wheels in the axial direction. When one or more of the first and second rope sections is displaced in the axial direction of the wheels away from a predefined zone, rotation of the drive wheel is stopped.

15 Claims, 3 Drawing Sheets

(51) Int. Cl.

| | |
|---|---|
| ***B66B 11/08*** | (2006.01) |
| ***B66B 7/12*** | (2006.01) |
| ***B66B 5/00*** | (2006.01) |
| *B66B 7/06* | (2006.01) |

(52) U.S. Cl.
CPC ..... *B66B 5/0031* (2013.01); *B66B 7/1215* (2013.01); *B66B 7/06* (2013.01)

(56) References Cited

U.S. PATENT DOCUMENTS

| | | | | |
|---|---|---|---|---|
| 5,578,801 | A * | 11/1996 | Hofmann | B66B 1/28 187/287 |
| 6,742,769 | B2 * | 6/2004 | Baranda | F16H 55/50 254/390 |
| 7,578,373 | B2 * | 8/2009 | Shiratsuki | B66B 5/12 187/391 |
| 2007/0062762 | A1 * | 3/2007 | Ach | B66B 7/062 187/266 |
| 2010/0259253 | A1 | 10/2010 | Nishiyori et al. | |
| 2011/0315489 | A1 * | 12/2011 | Nakamori | B66B 7/1215 187/391 |
| 2015/0329319 | A1 * | 11/2015 | Lehtinen | B66B 7/1215 187/254 |
| 2017/0057788 | A1 * | 3/2017 | Helenius | B66B 1/30 |

* cited by examiner

ELEVATOR HAVING A ROPE MONITORING ARRANGEMENT AND METHOD FOR CONTROLLING THE ELEVATOR

FIELD OF THE INVENTION

The invention relates to an elevator for transporting passengers and/or goods.

BACKGROUND OF THE INVENTION

An elevator typically comprises an elevator car and a counterweight, which are vertically movable in a hoistway. These elevator units are interconnected to each other by a hoisting roping. The hoisting roping is normally arranged to suspend the elevator units on opposite sides of a drive wheel. For providing force for moving the suspension roping, and thereby also for the elevator units, the elevator comprises a motor for rotating the drive wheel engaging the hoisting roping. The motor is automatically controlled by an elevator control system, whereby the elevator is suitable for automatically serving passengers.

In elevators, the hoisting roping comprises at least one but typically several elevator ropes passing alongside each other. The conventional elevators have steel ropes, but some elevators have ropes that are belt-shaped, i.e. their width is substantially greater than the thickness. As with any other kind of rope, position of the belt-shaped ropes relative to the drive wheel around which it passes (in the axial direction of the drive wheel) so that none of the ropes drifts in said axial direction away from the circumferential surface area of the drive wheel against which the rope in question is intended to rest.

Typically, in prior art, position of ropes in said axial direction has been controlled by providing the drive wheel and the rope engaging the drive wheel with a ribbed or toothed shapes complementary for each other, whereby movement of the rope in said axial direction is blocked by mechanical shape-locking. One alternative way to control position of the belt-shaped ropes in said axial direction is to shape the circumferential surface areas of the drive wheel cambered (also known as crowned). Each cambered circumferential surface area has a convex shape against the peak of which the rope rests. The cambered shape tends to keep the belt-shaped rope passing around it to be positioned such that it rests against the peak thereof, thereby resisting displacement of the rope far away from the point of the peak.

A drawback of the known elevators has been that moving of a rope in the axial direction outside its intended course, and further development of the problem into even more hazardous state have not been prevented in an adequately reliable manner. This has been difficult especially with elevators where said mechanical shape-locking between the drive wheel and the rope engaging the drive wheel has been inadequately reliable or unavailable for some reason such as due to preference to utilize cambered shape of the drive wheel for rope position control.

BRIEF DESCRIPTION OF THE INVENTION

The object of the invention is to provide an improved elevator as well as a method. The object of the invention is, inter alia, to alleviate previously described drawbacks of known solutions and problems discussed or implied later in the description of the invention. The object of the invention is to introduce an elevator and a method where rope position on the drive wheel can be simply, reliably and safely controlled. In particular, an elevator is introduced where running of a rope outside its intended course, and further development of the problem into even more hazardous state are prevented. Embodiments are presented, inter alia, in which after reacting to a problem situation with regard to rope position, the elevator can be brought to a safer state, and even recovered such that the passengers can be let out of the car. Embodiments are presented, inter alia, in which said objects are realized with simple and reliable configuration.

It is brought forward a new elevator comprising a first elevator unit vertically movable in a hoistway, and a second elevator unit vertically movable in a hoistway, at least one of said elevator units being an elevator car for receiving a load to be transported i.e. goods and/or passengers; one or more belt-shaped hoisting ropes interconnecting the first elevator unit and the second elevator unit and rope wheels including a drive wheel for moving said one or more belt-shaped hoisting ropes. Each of said one or more belt-shaped hoisting ropes passes around the drive wheel and comprises consecutively a first rope section extending between the drive wheel and the first elevator unit, and a second rope section extending between the drive wheel and the second elevator unit. The rope wheels further include one or more non-driven, i.e. freely rotating, cambered diverting wheels in proximity of the drive wheel, and each said first rope section is arranged to pass around a non-driven first cambered diverting wheel, in particular resting against a cambered circumferential surface area thereof. The elevator further comprises a rope monitoring arrangement configured to monitor displacement of each of said first rope sections in the axial direction of the rope wheels away from a predefined zone, and displacement of each of the second rope sections in the axial direction of the wheels away from a predefined zone. The elevator is configured to stop the rotation of the drive wheel when one or more of the first and second rope sections is displaced in the axial direction of the rope wheels away from a predefined zone, such as over a limit position delimiting the predefined zone. With this configuration, running of a rope outside its intended course in axial direction of the rope wheels, and further development of the problem into even more hazardous are prevented. Due to the monitoring arrangement, abnormal situations with regard to position of either rope section of a rope are detected and reacted to quickly and effectively, whereby safety and reliability of the system are facilitated, which is important because the axial control of rope position is provided largely by cambered rope wheel shape. By monitoring displacement of both the first and second rope section, it is also possible enabled that the elevator can be further controlled on the basis of displacement information, such as which of the rope sections is displaced or was displaced first, In a preferred embodiment, each said second rope section is arranged to pass around a second non-driven cambered diverting wheel, in particular resting against a cambered circumferential surface area thereof. Advantageously, the configuration thus provides, independently of drive direction, pre-guidance with a cambered wheel shape for the rope sections arriving at the drive wheel, as well as post-guidance with cambered wheel shape for the rope sections departing from the drive wheel. Thus, axial position can be ensured with both directions of movement of the rope(s). This is because axial rope position is predominantly controlled by the cambered diverting wheel which the rope enters first, which has now been found out by experimental work and analyses. Due to the monitoring arrangement, abnormal situations with regard to position of either rope section of a rope are reacted to quickly and effectively, whereby safety and reliability of the system are facilitated, which is important because the axial control of rope position is provided largely by cambered shape of the diverting wheels.

In a preferred embodiment, after rotation of the drive wheel in first of its two rotation directions such that each said first rope section runs from the drive wheel towards the first cambered wheel has been stopped triggered by displacement of one or more of the first and second rope sections away from a predefined zone, the elevator is configured to rotate the drive wheel slowly backwards without further rotation of the drive wheel in said rotation direction. As mentioned above, axial rope position is predominantly controlled by the cambered diverting wheel which the rope enters first. When shifted to backwards drive, the non-driven first cambered diverting wheel thus takes the predominant role and guides the first rope section back towards the predefined zone and the elevator is brought to a safer state.

In a preferred embodiment, after rotation of the drive wheel in first of its two rotation directions such that each said first rope section runs from the drive wheel towards the first cambered diverting wheel has been stopped triggered by displacement of one or more of the second rope sections away from a predefined zone, the elevator is configured to rotate the drive wheel slowly backwards without further rotation of the drive wheel in said rotation direction. Thus, the predominant role is given for the part of the elevator where problematic behavior did not originate in, In a preferred embodiment, the elevator is configured to continue said rotating the drive wheel slowly backwards until the car is level with the landing closest in direction where the car is moved by said backwards rotation. It is further preferable that the elevator is configured to open door(s) leading from the car to said landing when the car is level with said landing. Thereby, the elevator can be brought to state where passengers are free to exit the car.

In a preferred embodiment, when the drive wheel is rotated slowly backwards such that the car moves substantially slower than the nominal speed of the elevator. Thus, rope velocity, as well as car velocity can be maintained relatively safe and low so that risk of injuries is reduced in case a sudden stop still needs to be performed. Further, it is preferable that when the drive wheel is rotated slowly backwards, the circumferential speed of the drive wheel is preferably maintained constant.

In a preferred embodiment, when the drive wheel is rotated slowly backwards, the circumferential speed of the drive wheel is limited to be less than 2 m/s, preferably less 1 m/s. Thus, rope velocity, as well as car velocity can be maintained relatively safe and low so that risk of injuries is reduced in case a sudden stop needs to be performed. Further, it is preferable that when the drive wheel is rotated slowly backwards, the circumferential speed of the drive wheel is maintained constant. The elevator is preferably such that the circumferential speed of the drive wheel is substantially higher than said (limit) speed, when the car is moved with nominal speed of the elevator.

In a preferred embodiment, wherein the elevator is provided also with said non-driven second cambered diverting wheel, the elevator is preferably configured to rotate the drive wheel in first of its two rotation directions such that each said first rope section runs from the drive wheel towards the non-driven first cambered diverting wheel and each said second rope section runs from the second non-driven cambered diverting wheel towards the drive wheel; and to monitor displacement of each of the first rope sections in the axial direction of the wheels away from a predefined zone, and displacement of each of the second rope sections in the axial direction of the wheels away from a predefined zone, while the drive wheel is rotated in first of its two rotation directions; and to stop the rotation of the drive wheel in said first of its two rotation directions when one or more of the first and second rope sections is displaced in the axial direction of the wheels away from a predefined zone; and thereafter to rotate the drive wheel slowly backwards, i.e. in the second of its two rotation directions, without further rotation of the drive wheel in said first of its two rotation directions.

In a preferred embodiment, the elevator is configured to rotate the drive wheel slowly backwards as defined anywhere above only if one or more criteria are met. Preferably, said one or more criteria include at least one or both of the following:

none of the first rope sections are displaced in the axial direction of the rope wheels away from a predefined zone, stopping the rotation of the drive wheel in said first of its rotation directions was triggered by displacement of one or more of the second rope sections away from a predefined zone.

In a preferred embodiment, the elevator is configured to operate as defined anywhere above or elsewhere in the application, when the drive wheel is rotated to move the car in one of its two running directions (up or down), and the elevator is configured to operate in a corresponding manner when the drive wheel is rotated to move the car in the other of its two running directions (up or down).

In a preferred embodiment, the rope monitoring arrangement comprises a predefined zone individually for each first rope section as well as a predefined zone individually for each second rope section. Each first rope section as well as second rope section is thus individually disposed within one of said predefined zones. Thus, rope sections can be individually monitored. In the preferred case where there are plural ropes being arranged to pass adjacently, there are thus plural predefined zones adjacent each other. Each said predefined zone is preferably delimited by a first and a second limit position as will be described below. Each said predefined zone is preferably such that when a rope section is completely within the predefined zone associated therefor, the rope section is placed against the peak of the convex shape of the cambered diverting wheel around which the rope section in question passes.

In a preferred embodiment, the rope monitoring arrangement is configured to monitor displacement of each of said first rope sections as defined with at least one first detector, and displacement of each of said second rope sections as defined with at least one second detector.

In a preferred embodiment, the hoisting ropes are arranged to suspend the first and second elevator unit.

In a preferred embodiment, said rope monitoring arrangement comprises at least one first detector configured to detect displacement of each of said first rope sections in the axial direction of the rope wheels away from a predefined zone; and at least one second detector configured to detect displacement of each of said second rope sections in the axial direction of the rope wheels away from a predefined zone.

In a preferred embodiment, each said first detector is configured to detect displacement of each of said first rope sections in axial direction of the rope wheels over a first limit position or over a second limit position between which first and second limit position the first rope section is disposed, and each said second detector is configured to detect displacement of each of said second rope sections in axial direction of the wheels over a first limit position or over a second limit position, between which first and second limit position the second rope section is disposed.

In a preferred embodiment, each said predefined zone is delimited by a first and a second limit position. An individual rope section (i.e. a rope section of only one rope) is disposed within each predefined zone between the first and second limit position.

In a preferred embodiment, displacement of one or more of said first rope sections in the axial direction of the wheels away from a predefined zone, such as over a limit position delimiting the predefined zone, or displacement of one or more of said second rope sections in the axial direction of the rope wheels away from a predefined zone, such as over a limit position delimiting the predefined zone is arranged to trigger the elevator to stop rotation of the drive wheel.

In a preferred embodiment, said stopping of the rotation of the drive wheel includes braking its rotation with mechanical brake(s), the brake(s) preferably acting directly on the drive wheel or a directly on a component fixed on the drive wheel.

It is also brought forward a new method for controlling an elevator. The method is implemented in an elevator that comprises a first elevator unit vertically movable in a hoistway, and a second elevator unit vertically movable in a hoistway, at least one of said elevator units being an elevator car; one or more belt-shaped hoisting ropes interconnecting the first elevator unit and the second elevator unit; rope wheels including a drive wheel for moving said one or more belt-shaped hoisting ropes; wherein each of said one or more belt-shaped hoisting ropes passes around the drive wheel and comprises consecutively a first rope section extending between the drive wheel and the first elevator unit, and a second rope section extending between the drive wheel and the second elevator unit; and wherein the rope wheels further include one or more non-driven cambered diverting wheels, each said first rope section being arranged to pass around a non-driven first cambered diverting wheel, in particular resting against a cambered circumferential surface area thereof; and wherein the elevator further comprises a rope monitoring arrangement. The rope monitoring arrangement is preferably as described above or elsewhere in the application, in particular configured to monitor displacement of each of said first rope sections in the axial direction of the rope wheels away from a predefined zone, and displacement of each of the second rope sections in the axial direction of the wheels away from a predefined zone. The method comprises rotating the drive wheel in first of its two rotation directions, such that each said first rope section runs from the drive wheel towards the first cambered diverting wheel. The method further comprises monitoring displacement of each said first rope section in the axial direction of the wheels away from a predefined zone, such as over a limit position delimiting the predefined zone, as well as displacement of each said second rope section in the axial direction of the wheels away from a predefined zone, such as over a limit position delimiting the predefined zone, while the drive wheel is rotated in first of its two rotation directions; and stopping the rotation of the drive wheel in said first of its rotation directions when one or more of the first and second rope sections is displaced in the axial direction of the wheels away from a predefined zone, such as over a limit position delimiting the predefined zone. With this configuration one or more of the above described objectives are achieved.

In a preferred embodiment, each said second rope section is arranged to pass around a second non-driven cambered diverting wheel, in particular resting against a cambered circumferential surface area thereof. In this case, in said rotating the drive wheel in first of its two rotation directions, each said second rope section runs from the second cambered wheel towards the drive wheel.

In a preferred embodiment, the method comprises after said stopping, rotating the drive wheel slowly backwards, i.e. in the second of its two rotation directions, without further rotation of the drive wheel in said first of its two rotation directions.

In a preferred embodiment, the method comprises after said stopping, rotating the drive wheel slowly backwards, i.e. in the second of its two rotation directions, without further rotation of the drive wheel in said first of its two rotation directions only if one or more criteria are met.

In a preferred embodiment, said one or more criteria include at least one or both of the following:

- none of the first rope sections are displaced in the axial direction of the rope wheels away from a predefined zone,
- stopping the rotation of the drive wheel in said first of its rotation directions was triggered by displacement of one or more of the second rope sections away from a predefined zone.

In a preferred embodiment, in said rotating the drive wheel slowly backwards is continued until the car is level with the landing closest in direction where the car is moved by said backwards rotation, and the method preferably further comprises opening door(s) leading from car to said landing when the car is level with said landing.

In a preferred embodiment, the elevator is controlled as defined when the drive wheel is rotated to move the car in one of its two running directions (up or down), and the elevator is controlled in a corresponding manner when the drive wheel is rotated to move the car in the other of its two running directions (up or down).

In a preferred embodiment, when the drive wheel is rotated slowly backwards such that the car moves substantially slower than the nominal speed of the elevator. Further, it is preferable that when the drive wheel is rotated slowly backwards, the circumferential speed of the drive wheel is preferably maintained constant.

In a preferred embodiment, when the drive wheel is rotated slowly backwards, the circumferential speed of the drive wheel is limited to be less than 2 m/s, preferably less 1 m/s.

In a preferred embodiment, the displacement of each of said first rope sections is monitored as defined with at least one first detector, and displacement of each of said second rope sections is monitored as defined with at least one second detector.

In a preferred embodiment, the hoisting ropes are arranged to suspend the first and second elevator unit.

In a preferred embodiment, said stopping of the rotation of the drive wheel includes braking its rotation with mechanical brake(s), the brake(s) preferably acting directly on the drive wheel or directly on a component fixed on the drive wheel.

In a preferred embodiment, both the first and second rope section diverge from the drive wheel towards the same lateral side thereof, the first rope section a passing over a first cambered diverting wheel, in particular resting against a cambered circumferential surface area thereof, and therefrom straight down to the first elevator unit, and the second rope section b passing over a second cambered diverting wheel, in particular resting against cambered circumferential surface area thereof, and therefrom straight down to the second elevator unit. It has been found by experimental work and analyzing that certain minimum contact length between rope and a cambered diverting wheel is required to ensure proper control of rope position in axial direction of the cambered diverting wheel. When the drive wheel has been positioned such relative to diverting wheels that the rope sections of a rope diverge in the defined way from the drive wheel towards the same lateral side thereof, the contact length between rope and the diverter wheel can be without problems be set, with any rope-to-rope distance, to be adequately long to enable the cambered shape to act effectively on the rope. This is realized also when rope-to-rope distance is wider than but close to the diameter of the drive wheel. Thus, with the defined elevator construction also this kind of configuration can be safely implemented.

In a preferred embodiment, both the first diverting wheel and the second diverting wheel are completely at one lateral side of the drive wheel.

In a preferred embodiment, one or both of said first and second diverting wheel diverts the angle of the ropes substantially more than 90 degrees. Thus, contact length between rope and a cambered diverting wheel is positively adequate for proper control of rope position in axial direction of the cambered diverting wheel.

In a preferred embodiment, the drive wheel is cambered, particularly comprising a cambered circumferential surface area for each of said one or more ropes against which circumferential surface area the rope in question is arranged to rest.

In a preferred embodiment, each said cambered circumferential surface area has a convex shape having a peak against which one of said one or more ropes rests.

In a preferred embodiment, one of the elevator units is an elevator car and the second is a counterweight or a second elevator car.

In a preferred embodiment, both the cambered circumferential surface area as well as the surface of the rope resting against it are smooth.

In a preferred embodiment, each rope passes around the rope wheels a wide side of the rope resting against the wheels.

In a preferred embodiment, the drive wheel has a first and second rotation direction (clockwise and counterclockwise).

In a preferred embodiment, for ensuring proper effect of the cambered diverting wheels with regard to the axial control of the ropes, each said cambered diverting wheels is in proximity of the drive wheel, in particular such that the length of the portion of the first rope section a extending between first cambered diverting wheel and the drive wheel is less than 2 meters, more preferably less than 1.5 meters, and the length of the portion of the second rope section b extending between second cambered diverting wheel and the drive wheel is less than 2 meters, more preferably less than 1.5 meters in case the system comprises said second cambered diverting wheel. The car is preferably arranged to serve two or more landings. The car preferably responds to calls from landing and/or destination commands from inside the car so as to serve persons on the landing(s) and/or inside the elevator car. Preferably, the car has an interior space suitable for receiving a passenger or passengers, and the car can be provided with a door for forming a closed interior space.

BRIEF DESCRIPTION OF THE DRAWINGS

In the following, the present invention will be described in more detail by way of example and with reference to the attached drawings, in which.

The foregoing aspects, features and advantages of the invention will be apparent from the drawings and the detailed description related thereto.

DETAILED DESCRIPTION

Figure 1:
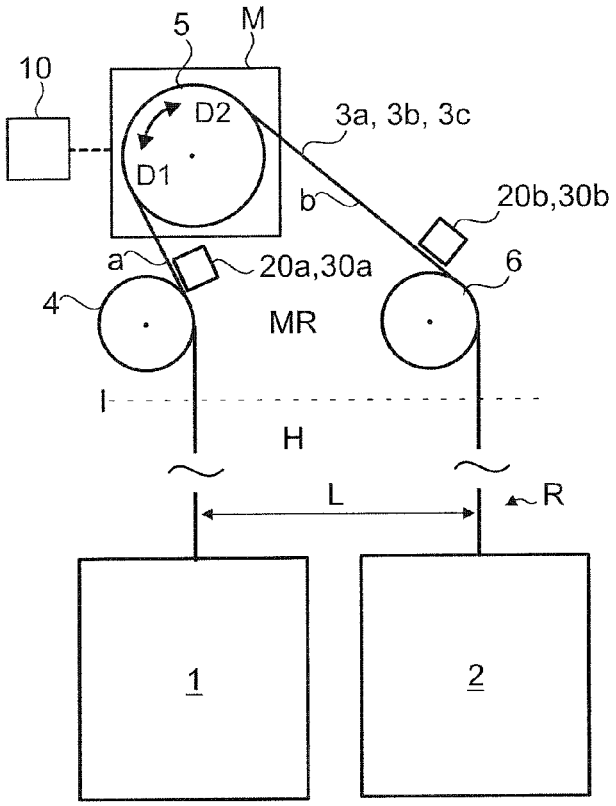
FIG. 1 illustrates schematically an elevator according a preferred embodiment.

FIG. 1 illustrates an elevator according to a preferred embodiment. The elevator comprises a hoistway H and a first elevator unit 1 vertically movable in the hoistway H and a second elevator unit 2 vertically movable in the hoistway H. At least one of said elevator units 1,2 is an elevator car for receiving a load to be transported i.e. goods and/or passengers. The other one is preferably a counterweight, but alternatively it could be a second elevator car.

The elevator further comprises a hoisting roping R comprising one or more belt-shaped hoisting ropes 3*a*,3*b*,3*c* interconnecting the first elevator unit 1 and the second elevator unit 2 and passing around rope wheels 4,5,6, said rope wheels 4,5,6 having parallel rotational axes.

For moving the one or more belt-shaped hoisting ropes 3*a*,3*b*,3*c*, and thereby also for moving the elevator units 1,2, said rope wheels 4,5,6 include a drive wheel 5. Each of said one or more belt-shaped hoisting ropes 3*a*,3*b*,3*c* passes around the drive wheel 5 and comprises consecutively a first rope section a extending between the drive wheel 5 and the first elevator unit 1, and a second rope section b extending between the drive wheel 5 and the second elevator unit 2. Thus, each said first rope section a is on one side of the drive wheel and each said second rope section b is on the other (opposite) side of the drive wheel 5. The elevator comprises a motor M for rotating the drive wheel 5 engaging the one or more hoisting ropes 3*a*,3*b*,3*c* whereby motorized rotation of the drive wheel 5 is enabled. The elevator further comprises an automatic elevator control 10 arranged to control the motor M. Thereby movement of the elevator units 1,2 is automatically controllable.

The elevator further comprises a non-driven, i.e. freely rotating, first cambered diverting wheel 4 in proximity of the drive wheel 5. Each said first rope section a is arranged to pass around the first non-driven cambered diverting wheel 4, in particular resting against a cambered circumferential surface area A,B,C thereof. In the embodiment illustrated, the elevator further comprises a non-driven, i.e. freely rotating, second cambered diverting wheel 6 in proximity of the drive wheel 5. Each said second rope section b is arranged to pass around the second non-driven cambered diverting wheel 6, in particular resting against a cambered circumferential surface area A,B,C thereof. Thereby, rope sections on both sides of the drive wheel 5 are diverted by a non-driven cambered diverting wheel. The rope extending between the first elevator unit 1 and the second elevator unit 2 passes around the first non-driven cambered diverting wheel 4, a drive wheel 5, and a second non-driven cambered diverting wheel 6, in this order. Thereby, arrival of the rope to the drive wheel 5 as well as departure of the rope from the drive wheel 5 is controlled in terms of its axial position independently of drive direction.

Figure 2:
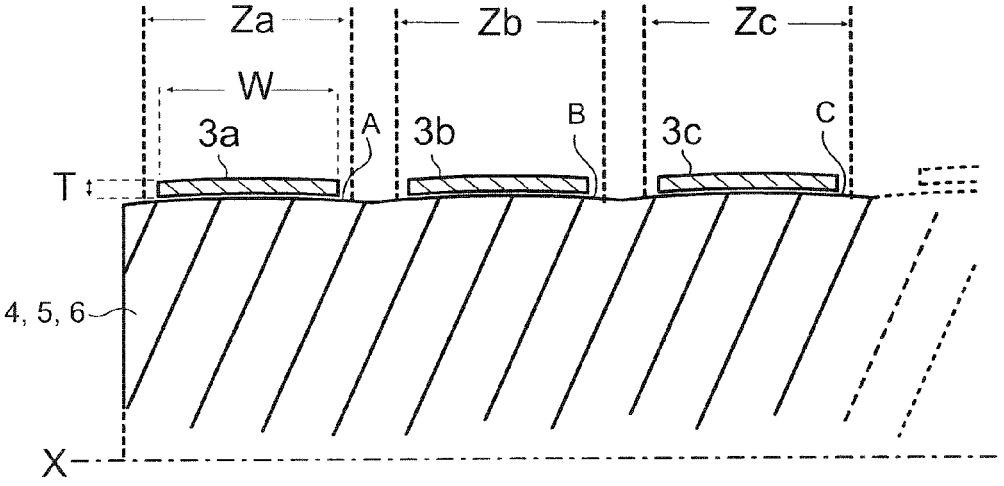
FIG. 2 illustrates schematically a cross section of the rope wheels of FIG. 1.

Passage of the ropes around said wheels 4,5,6 is illustrated in FIG. 2 showing a cross sectional view of the ropes as they are positioned against each wheel. The drive wheel 5 is in the preferred embodiment also cambered in the same way as the non-driven cambered diverting wheels 4,6. The non-driven cambered diverting wheels 4,5,6 comprise a cambered circumferential surface area A,B,C for each of said one or more ropes 3*a*,3*b*,3*c* against which circumferential surface area A,B,C the rope in question is arranged to rest. In this way the position of each belt-shaped rope in axial direction of the wheels 4,5,6 around which it passes, is controlled. In these embodiments, each cambered circumferential surface area A,B,C has a convex shape against the peak of which the rope rests. The cambered shape tends to keep the rope passing around it positioned resting against the peak thereof, thereby resisting displacement of the rope 3*a*,3*b*,3*c* away from this position in said axial direction X.

The elevator further comprises a rope monitoring arrangement configured to monitor displacement of each of said first rope sections a,b in the axial direction of the rope wheels 4,5,6 away from a predefined zone Za,Zb,Zc and displacement of each of the second rope sections in the axial direction of the wheels 4,5,6 away from a predefined zone Za,Zb,Zc. The elevator is configured to stop the rotation of the drive wheel 5 when one or more of the first and second rope sections a,b is displaced in the axial direction of the wheels 4,5,6 away from the predefined zone Za,Zb,Zc. Thus, position of the ropes on the drive wheel 5 can be simply, reliably and safely controlled. In particular, running of a rope outside its intended course, and further development of the problem situation to be more hazardous are prevented with appropriate and swift reaction.

Said stopping can be implemented such that displacement of one or more of said first rope sections a in the axial direction of the wheels 4,5,6 away from a predefined zone or displacement of one or more of said second rope sections b in the axial direction of the wheels 4,5,6 away from a predefined zone is arranged to trigger the elevator to stop the rotation of the drive wheel 5.

In the embodiment presented, the hoisting ropes 3*a*,3*a*,3*a* are more specifically suspension ropes, and for this purpose arranged to suspend the first and second elevator unit 1,2. In this case, the rope wheels 4,5,6 are mounted in the upper end of the hoistway H or in proximity thereof, e.g. in a machine room formed above or beside the upper end of the hoistway. The two elevator units 1,2 form a balancing weight for each other whereby they are economical to move. In FIG. 2, a machine room MR is formed above the hoistway H, where the elevator units 1 and 2 travel. Dashed line I represents the floor line of the machine room MR. It is of course obvious, that the elevator could alternatively be implemented without a machine room and/or such that the elevator units travel in different hoistways.

It is preferable, although not necessary, that both rope sections a, b diverge from the drive wheel 5 towards the same lateral side thereof (towards right in FIG. 1), as illustrated, the first rope section a passing over a first cambered diverting wheel 4, in particular resting against a cambered circumferential surface area A,B,C thereof, and therefrom straight down to the first elevator unit 1, and the second rope section b passing over a second cambered diverting wheel 6, in particular resting against cambered circumferential surface area A,B,C thereof, and therefrom straight down to the second elevator unit 2. The horizontal distance (L-distance) between the vertically oriented rope section extending between the first rope wheel and the first elevator unit 1 and the vertically oriented rope section extending between the second rope wheel and the second elevator unit 2 is marked in the Figures with L. The drive wheel 5 and the diverting wheels 4,6 being positioned such relative to each other that the rope sections a,b of a rope diverge from the drive wheel 5 towards the same lateral side thereof, the contact length between rope and the diverter wheel is with any rope-to-rope distance L adequately long to enable the cambered shape of the one of the diverting wheels 4,6, wherefrom the rope arrives to the drive wheel 5, to act effectively on the rope 3*a*,3*b*,3*c*.

In the embodiment illustrated in FIG. 1, the first rope section a diverges from the drive wheel 5 obliquely downwards to the first diverting wheel 4, and the second rope section b diverges from the drive wheel 5 obliquely downwards to the second diverting wheel 6. Thus, a contact length between the ropes and the drive wheel 5 can be kept adequate for most elevators. This facilitates also the overall slimness of the configuration of wheels 4,5,6. The angle could be alternatively something else. For example, both rope sections could diverge from the drive wheel 5 horizontally or obliquely upwards or in any combination of the alternatives mentioned.

It is preferable that the elevator is configured to carry out steps for recovering from a stop situation caused by the displacement of one or more of the first and second rope sections a,b in the axial direction of the wheels 4,5,6 away from the predefined zone Za,Zb,Zc such that the passengers can be let out of the car.

For this purpose, in the preferred embodiment after rotation of the drive wheel 5 in the first D1 of its two rotation directions D1,D2, such that each said first rope section a runs from the drive wheel 5 towards the first cambered rope wheel 4 has been stopped triggered by displacement of one or more of the rope sections a,b away from a predefined zone, the elevator is configured to rotate the drive wheel 5 slowly backwards without further rotation of the drive wheel 5 in said first rotation direction D1. Thus, the development of the situation can be stopped and reversed. That is, the traveling of a rope in the axial direction outwards from its predefined zone can be stopped and reversed back towards the predefined zone. Thus, it is possible to provide the elevator with automatic rope realignment function. During said backwards rotation, the rope section a arriving at the drive wheel 5 will receive pre-guidance from a cambered diverting wheel. To implement the above mentioned operations in an elevator having said cambered diverting wheel on both sides of the drive wheel 5, it is preferable that the elevator is, more specifically, configured to rotate the drive wheel 5 in first D1 of its two rotation directions D1, D2 such that each said first rope section a runs from the drive wheel 5 towards the first cambered wheel 4 and each said second rope section b runs from the second cambered wheel 6 towards the drive wheel 5; and to monitor displacement of each of the first rope sections in the axial direction of the wheels away from a predefined zone and displacement of each of the second rope sections in the axial direction of the rope wheels 4,5,6 away from the predefined zone, such as over a limit position, while the drive wheel 5 is rotated in first D1 of its two rotation directions D1,D2; and to stop the rotation of the drive wheel 5 in said first of its rotation D1 directions when one or more of the first and second rope sections a,b is displaced in the axial direction of the rope wheels 4,5,6 away from a predefined zone Za,Zb,Zc, such as over a limit position; and thereafter to rotate the drive wheel 5 slowly backwards in the second D2 of its two rotation directions D1,D2 without further rotation of the drive wheel 5 in said first D1 of its two rotation directions.

It is preferable that the backwards rotation is not carried out in all situations. For the sake of safety and effectiveness, it is preferable that the elevator is configured to rotate the drive wheel 5 slowly backwards as defined anywhere above only if one or more criteria are met. Said one or more criteria include at least one (either one) but preferably both of the following:

- none of the first rope sections a are displaced in the axial direction of the wheels 4,5,6 away from its predefined zone,
- stopping the rotation of the drive wheel 5 in said first D1 of its rotation directions D1,D2 was triggered by displacement of one or more of the second rope sections b away from its predefined zone.

These criteria are based on an idea that the cambered diverting wheel, which carries out the pre-guidance of the rope arriving at the drive wheel 5 is in dominating role, in terms of its effect on axial position of a rope, in particular relative to a cambered diverting wheel that carries out the post-guidance of the rope departing from the drive wheel 5. It is also noticed, that displacement the rope in said axial direction diminishes between the rope wheels in the direction of rope travel. The advantage of the first of said criteria is that in this way it is ensured that the cambered diverting wheel that will take the role of pre-guidance when the reversing is to be carried out, is capable of fully functional axial control of the ropes passing around it. Accordingly, thus it can be ensured that the diverting wheel that is in dominating role with respect to axial control of ropes will indeed guide the ropes towards the predefined zone. Whatever the situation with the post-guiding diverting wheel is, the axial control of the dominating diverting wheel prevails. The advantage of the second of said criteria is that in this way it is ensured that the cambered diverting wheel that will take the role of pre-guidance when the reversing is to be carried out, is not responsible for guiding of the rope section that was the first to be displaced and thereby likely at the moment of reversing worst displaced. It results that the role of predominant pre-guidance is given for the rope section a that is unlikely the rope section that caused the problematic behavior. Taking into account that displacement the rope in said axial direction diminishes between the rope wheels in the direction of rope travel, the diverting wheel that will be in dominating role with respect to axial control of ropes will guide the ropes towards the predefined zone. Whatever the situation with the post-guiding diverting wheel is, the axial control of the dominating diverting wheel prevails.

Preferably, the elevator is configured to continue said rotating the drive wheel 5 slowly backwards until the car is level with the landing closest in direction where the car is moved by said backwards rotation, and to open door(s) leading from car to said landing when the car is level with said landing.

In the preferred embodiment, the rope monitoring arrangement is configured to monitor displacement of each of said first rope sections a as defined with at least one first detector 20*a*,30*a*, and displacement of each of said second rope sections b as defined with at least one second detector 20*b*,30*b*. Accordingly, the first and second rope sections are monitored with separate detectors. As illustrated in FIG. 1, said rope monitoring arrangement comprises a first detector 20*a*,30*a* configured to detect displacement of each of said first rope sections a in the axial direction of the rope wheels 4,5,6 away from a predefined zone and a second detector 20*b*,30*b* configured to detect displacement of each of said second rope sections (b) in the axial direction of the rope wheels 4,5,6 away from a predefined zone.

The detectors are preferably, but not necessarily, such that each said first detector 20*a*,30*a* is configured to detect displacement of each of said first rope sections a in the axial direction over a first limit position L1*a*,L1*b*,L1*c* or over a second limit position L2*a*,L2*b*,L2*c*, between which first and second limit position L1*a*,L1*b*,L1*c*; L2*a*,L2*b*,L2*c* the first rope section is disposed, and each said second detector 20*b*,30*b* is configured to detect displacement of each of said second rope sections b in axial direction over a first limit position L1*a*,L1*b*,L1*c* or over a second limit position L2*a*, L2*b*,L2*c*), between which first and second limit position L2*a*,L2*b*,L2*c*; L1*a*,L1*b*,L1*c* the second rope section b is disposed. Said first and second limit position L1*a*,L1*b*,L1*c*; L2*a*,L2*b*,L2*c* then delimit said predefined zone Za,Zb,Zc of the rope in question. In this case, displacement of one or more of said first rope sections a in the axial direction of the rope wheels 4,5,6 away from a predefined zone, in particular over a limit position delimiting a predefined zone, or displacement of one or more of said second rope sections b in the axial direction of the rope wheels 4,5,6 away from a predefined zone Za,Zb,Zc, in particular over a limit position delimiting a predefined zone is arranged to trigger stopping of the rotation of the drive wheel 5.

In general, it is possible that said one or more belt-shaped suspension ropes 3*a*,3*b*,3*c* comprises only one of these ropes arranged as defined, but preferably said one or more belt-shaped hoisting ropes comprises plurality of belt-shaped hoisting ropes. In the embodiment illustrated there are at least three of belt-shaped hoisting ropes. The ropes being belt-shaped they have two wide sides facing in thickness direction of the rope (in FIG. 2 upwards and downwards), as well as lateral flanks facing in width direction of the rope (in FIG. 2 left and right). Each rope 3*a*,3*b*,3*c* passes around the diverting wheels 4,6 and the drive wheel 5 a wide side of the rope against the wheel in question. When there are several ropes, as illustrated, the ropes 3*a*,3*b*,3*c* pass around the diverting wheels 4,6 and the drive wheel 5 adjacent each other in said axial direction of the wheels 4,5,6 as well as adjacent each other in the width-direction w of the ropes.

Preferably, the circumferential surface area A,B,C as well as the surface of the rope via which the rope rest against the circumferential surface area A,B,C in question are both smooth such that neither of said circumferential surface area A,B,C nor the rope has protrusions extending into recesses of the other. Thereby, the control of axial position of each rope is provided by the shape of the cambered circumferential surface area A,B,C against which the rope rests. Also, traction of each rope is based on frictional contact between the drive wheel 5 and the rope. Therefore, not said circumferential surface area nor the rope surface need not be configured for engaging to each other via a polyvee- or toothed engagement.

It is preferable, that each of said one or more ropes 3*a*,3*b*,3*c* comprises one or more continuous load bearing members (not illustrated), which load bearing members extend in longitudinal direction of the rope 3*a*,3*b*,3*c* throughout the length of the rope 3*a*,3*b*,3. Preferably, the one or more continuous load bearing members is/are embedded in elastic coating forming the surface of the rope. Thus, the rope is provided with a surface via which the rope can effectively engage frictionally with the cambered wheels and the drive wheel in terms of axial position control as well as traction. The coating is preferably made of elastomer, such as polyurethane. In general, the elastic coating provides the rope 3*a*,3*b*,3*c* good wear resistance, protection, and isolates the load bearing members from each other. So as to provide the rope 3*a*,3*b*,3*c* with a turning radius well suitable for elevator use, it is preferable that the width/thickness ratio of the rope is substantial, in particular more than 2, preferably more than 4 as illustrated. Thus, reasonable bending radius can be achieved for the rope 3*a*,3*b*,3*c*.

In a preferred embodiment an elevator described anywhere above is controlled. The method for controlling an elevator comprises rotating the drive wheel 5 in first D1 of its two rotation directions D1,D2 in particular such that each said first rope section a runs from the drive wheel 5 towards the first cambered wheel 4. In the embodiment, wherein a cambered diverting wheel is provided on both sides of the drive wheel 5, each said second rope section b runs from the second diverting wheel towards the drive wheel 5. The method further comprises monitoring displacement of each said first rope section in the axial direction of the rope wheels away from a predefined zone Za, Zb, Zc such as over a limit position, as well as displacement of each said second rope section b in the axial direction of the wheels 4,5,6 away from a predefined zone Za, Zb, Zc such as over a limit position while the drive wheel 5 is rotated in said first D1 of its two rotation directions D1,D2; and stopping the rotation of the drive wheel 5 in said first D1 of its rotation directions D1,D2 when one or more of the first and second rope sections a,b is displaced in the axial direction of the rope wheels 4,5,6 away from a predefined zone Za, Zb, Zc, such as over a limit position delimiting the predefined zone Za,Zb,Zc.

As already mentioned earlier, it is preferable that the elevator is configured to carry out steps for recovering from a stop situation caused by the displacement of one or more ropes from the predefined zone Za,Zb,Zc such that the passengers can be let out of the car. For this end, the method preferably comprises after said stopping rotating the drive wheel 5 slowly backwards in the second D2 of its two rotation directions D1,D2 without further rotation of the drive wheel 5 in said first D1 of its two rotation directions D1,D2.

For the sake of safety and effectiveness, it is preferable that the method comprises after said stopping said rotating the drive wheel 5 slowly backwards in the second of its two rotation directions without further rotation of the drive wheel 5 in said first of its two rotation directions only if one or more criteria are met. Said one or more criteria include at least one (either one) but preferably both of the following:

- none of the first rope sections a are displaced in the axial direction of the wheels 4,5,6 away from its predefined zone,
- stopping the rotation of the drive wheel 5 in said first D1 of its rotation directions D1,D2 was triggered by displacement of one or more of the second rope sections b away from its predefined zone Za, Zb, Zc.

Preferably, said rotating the drive wheel 5 slowly backwards is continued until the car is level with the landing closest in direction where the car is moved by the backwards rotation, and the method comprises opening door(s) leading from car to said landing when the car is level with said landing. Said door(s) include the doors, such as car door and landing door that are necessary to be opened for allowing passenger to exit the car.

Above, it is described the operation of the elevator when the drive wheel is rotated in first of its rotation directions to move the car in one of its two running directions (up or down). As mentioned and illustrated, the elevator preferably comprises a non-driven cambered diverting wheel 4,6 on both sides of the drive wheel 5. This makes it possible that the elevator operates in a corresponding manner as above described when the drive wheel is rotated to move the car in the other of its two running directions (up or down). The operation can be arranged symmetrically on opposite sides of the drive wheel 5, because there is a cambered diverting wheel acting on each of the first and second rope sections a,b and the monitoring is focused on each of the first and second rope sections a,b.

Preferably, the displacement of each of said first rope sections a is monitored as defined with at least one first detector 20*a*,30*a*, and displacement of each of said second rope sections b is monitored as defined with at least one second detector 20*b*,30*b*.

FIGS. 3-5 and 6-7 illustrate alternative embodiments for detectors by which the rope monitoring arrangement is configured to monitor displacement of each of said first rope sections a away from a predefined zone and displacement of each of said second rope sections b away from a predefined zone. In these cases, each predefined zone Za,Zb,Zc is delimited by a first limit position L1*a*,L1*b*,L1*c* and second limit position L2*a*,L2*b*,L2*c*. Each rope section is individually disposed between a first and a second limit position L2*a*,L2*b*,L2*c*; L1*a*,L1*b*,L1*c*. Said limit positions delimit the predefined zone Za,Zb,Zc of each individual rope section a,b. The predefined zone Za,Zb,Zc is the allowed range of movement for the rope section in question in axial direction of said wheels 4,5,6.

Upon displacement of a rope section away from the predetermined zone Za,Zb,Zc, in this case particularly over a limit position, stopping of the rotation of drive wheel 5 is triggered. Drifting of the rope 3*a*,3*b*,3*c* away from its intended course is thus reacted to by bringing the elevator into a swift stop. The limits positions L1*a*, L2*a*; L1*b*, L2*b*; L1*c*,L2*c* are preferably such that when the rope section a,b of the rope 3*a*,3*b*,3*c* in question is completely between the first and second limit position L1*a*, L2*a*; L1*b*, L2*b*; L1*c*,L2*c* defined for it, the rope section is placed against the peak of the convex shape of the cambered diverting wheel around which the rope section in question passes.

Figure 3:
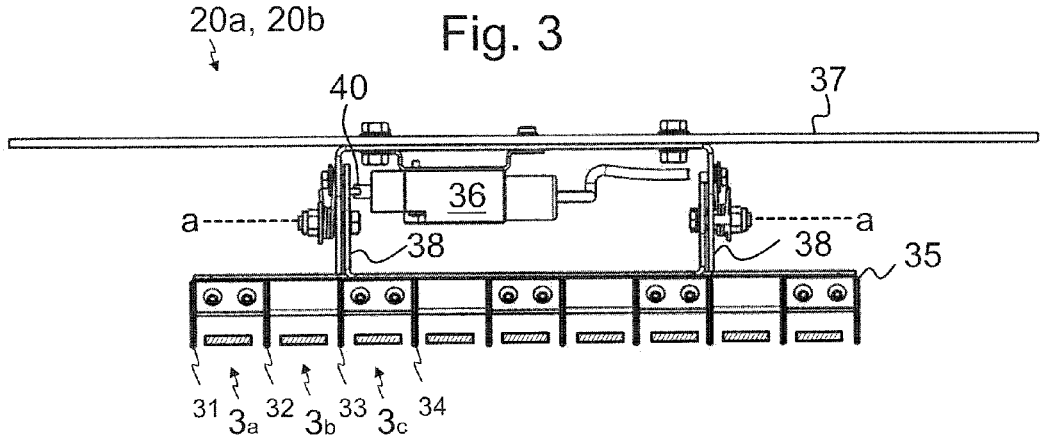
FIG. 3 illustrates a detector according to a first preferred embodiment.
Figure 4:
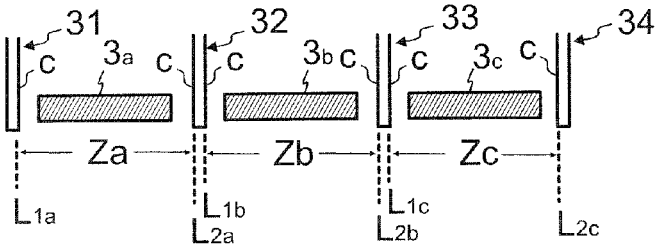
FIG. 4 illustrates an enlarged view of FIG. 3.
Figure 5:
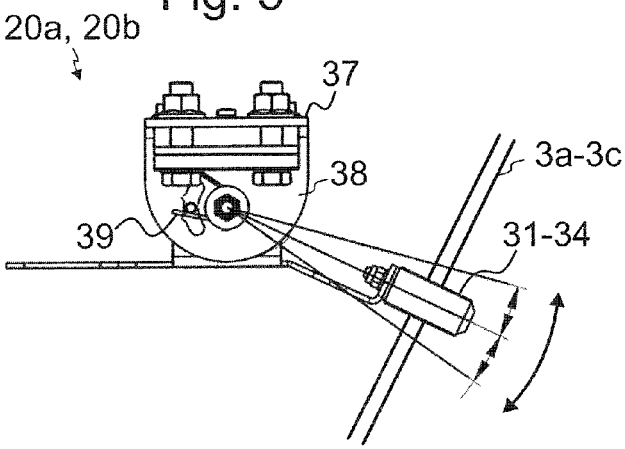
FIG. 5 illustrates a side-view of FIG. 3.

FIG. 3 illustrates a preferred first embodiment for the detector 20*a*,20*b*. The detector 20*a*,20*b* comprises for each rope on opposite sides of the rope 3*a*,3*b*,3*c* in said axial direction of the wheels 4,5,6 a first and a second sensing member 31,32; 32, 33; 33,34. In the embodiment as illustrated, there are several ropes whereby there are sensing members which extend between the ropes next to each other. Each sensing member comprises a contact face c which the rope next to it can contact when the rope in question is displaced in said axial direction. Each first sensing member 31,32,33 is positioned at the first limit position L1*a*,L1*b*,L1*c* of the rope in question, such that a contact face c thereof is positioned at the point of the limit position L1*a*,L1*b*,L1*c*. Each second sensing member 32,33,34 is positioned correspondingly at the second limit position L2*a*,L2*b*,L2*c* of the rope in question such that a contact face c thereof is positioned at the point of the limit position L2*a*,L2*b*,L2*c*, and each sensing member 31,32; 32, 33; 33,34 is arranged to be displaceable pushed by the rope, which is displaced in said axial direction such that it collides into contact with the sensing member in question. Displacement of each sensing member 31,32,33,34 is arranged to trigger said stopping. FIG. 4 illustrates a partial and enlarged view of FIG. 3.

Each of said sensing members 31,32,33,34 is displaceable at least in the longitudinal direction of the rope 3*a*,3*b*,3*c*, whereby the rope 3*a*,3*b*,3*c*, when it moves in its longitudinal direction during elevator use, in particular during car movement, and is displaced in said axial direction to collide into contact with the sensing member 31,32,33,34, is arranged to engage the sensing member 31,32,33,34 next to it and push it at least in the longitudinal direction of the rope 3*a*,3*b*,3*c*. Thus, when the rope 3*a*,3*b*,3*c* has engaged with a sensing member 31,32,33 or 34 next to it, the rope 3*a*,3*b*,3*c* can displace the sensing member 31,32,33,34 in question by its movement. The sensing member 31,32,33 or 34 in question moves then along with the rope 3*a*,3*b*,3*c* after said engagement, whereby chafing between the rope 3*a*,3*b*,3*c* and the sensing member 31,32,33 or 34 engaging it, is not extensive enough to cause damage to the rope 3*a*,3*b*,3*c*. Said engagement is preferably frictional. The contact surface c of each sensing member 31,32,33,34 is preferably elastically displaceable in said axial direction so as to ensure gentle contact. For this purpose the contact surface c is made of elastic material and/or the sensing member is elastically bendable in said axial direction. The elastic material is preferably elastomer, such as rubber, silicon or polyurethane, for instance. The elasticity of the contact surface c also facilitates firm frictional engagement between the rope 3*a*,3*b*,3*c* and the sensing member 31,32,33,34. In this embodiment, displacement of each sensing member 31,32,33,34 is arranged to trigger said stopping.

So as to provide for the sensing members said displaceability at least in the longitudinal direction of the rope 3*a*,3*b*,3*c*, preferably each of said sensing members 31,32,33,34 is mounted pivotally displaceably around an axis a, which axis is parallel with the axial direction of the wheels 4,5,6. Pivoting displacement of each sensing member 31,32,33,34 is arranged to trigger said stopping of the drive wheel 5. In the preferred embodiment, the sensing members 31,32,33,34 are mounted displaceably in the above defined way via a common pivotally displaceable carrier body 35. Thus, the displaceability need not be provided for them individually. Thus, the structure has small amount of moving parts, whereby it is reliable, simple, and easy to manufacture. The carrier body 35 is preferably mounted pivotally on a frame 37 mounted stationary.

In the preferred embodiment, each of said sensing members 31,32,33,34 is mounted pivotally displaceably towards either turning direction around said axis a. Thus, the sensing members 31,32,33,34 can be engaged by the rope 3*a*,3*b*,3*c* and be displaced pushed by the rope at least in the longitudinal direction of the rope 3*a*,3*b*,3*c* independently of the movement direction of the rope.

In the preferred embodiment, said means 30 for detecting displacement comprise at least one electrical sensor 36, arranged to sense position of the displaceable carrier body 35. The sensor is preferably in the form of a switch having a sensing nose 40 sensing the position of the carrier body 35. The detector preferably also comprise means 39 for resisting said displacement of the carrier body 35. Said means 30 are in the embodiment illustrated in FIG. 5 in the form of one or more spring 39 arranged to resist pivoting of the carrier body 35. The spring(s) is/are preferably also used for keeping the sensing members positioned such that the sensing members can pivot towards either direction around axis a. The spring(s) is preferably a helical spring mounted coaxially along the axis a between the carrier body 35 and the frame 37. For achieving the triggering stopping of the rotation of the drive wheel 5 said sensor 36 can be connected to elevator control 10 connected with the motor M and a machine brake of the elevator and thereby capable of performing the necessary steps related to said stopping. Alternatively, said sensor 36 can either include or be connected to a relay operating a safety switch of the safety circuit of the elevator, for instance.

Figure 6:
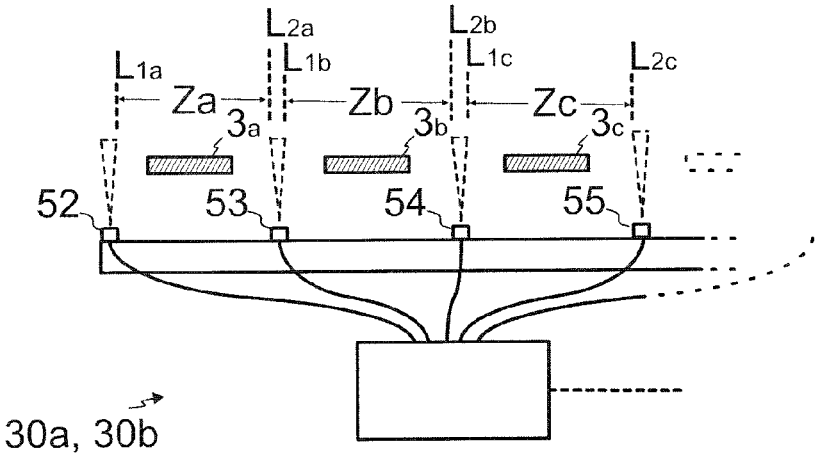
FIG. 6 illustrates a detector according to a second preferred embodiment.
Figure 7:
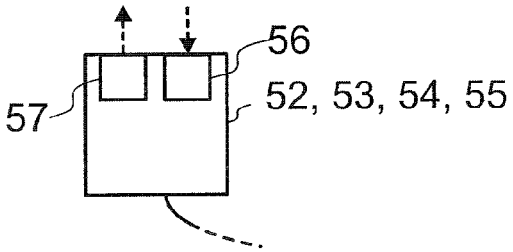
FIG. 7 illustrates details of sensing devices of FIG. 6.

FIG. 6 illustrates a second embodiment for the detector 30*a*,30*b*. The detector 30*a*,30*b* comprises sensing devices 52-55 for receiving electromagnetic radiation or ultrasonic sound from said limit positions L1*a*,L2*a*,L1*b*,L2*b*;L1*c*,L2*c* and a monitoring unit 51, connected to the sensing devices and arranged to trigger said stopping of the drive wheel 5 if electromagnetic radiation or ultrasonic sound received from one or more of said limit positions L1*a*,L2*a*;L1*b*,L2*b*,L1*c*, L2*c* meet(s) predetermined criteria, such as reaches a predetermined limit or changes in a predetermined way. Each sensing device 52-55 may be in the form of a photocell, infrared, microwave or laser beam sensor, ultrasonic sound sensor for instance. Said sensing devices 52-55 each comprise a receiver for receiving electromagnetic radiation or ultrasonic sound from a limit position L1*a*,L2*a*;L1*b*,L2*b*, L1*c*,L2*c* it is associated with. FIG. 7 illustrates a preferred structure for a sensing device of 52,53,54,55. Preferably, in addition to a receiver 56 each sensing device 52-55 additionally comprises a sender 57 for sending electromagnetic radiation or ultrasonic sound (if the receiver is a receiver for receiving ultrasonic sound) towards the limit position L1*a*, L2*a*,L1*b*,L2*b*;L1*c*,L2*c* it is associated with, whereby the electromagnetic radiation or ultrasonic sound sent by the sender towards the limit position L1*a*,L2*a*,L1*b*,L2*b*,L1*c*,L2*c* is reflected from a rope displaced over the limit position in question. Electromagnetic radiation or ultrasonic sound received by the receiver associated with the limit position L1*a*,L2*a*,L1*b*,L2*b*;L1*c*,L2*c* in question is arranged to be monitored by the monitoring unit 51, and if the electromagnetic radiation or ultrasonic sound received from one or more of said limit positions L1*a*,L2*a*;L1*b*,L2*b*;L1*c*,L2*c* meet (s) predetermined criteria, the monitoring unit 51 is arranged to trigger said stopping. For achieving the triggering of said stopping said monitoring unit 51 can be connected to elevator control 10 connected with the motor M and a machine brake of the elevator and thereby capable of performing the necessary steps related to said stopping. Alternatively, said monitoring unit 51 can either include or be connected to a relay operating a safety switch of the safety circuit of the elevator, for instance.

In FIG. 6, the positions whereto the sensing devices 52-55 are arranged to send said electromagnetic radiation or ultrasonic sound, and wherefrom the sensing devices 52-55 are arranged to receive said electromagnetic radiation or ultrasonic sound from are illustrated as beams drawn in dashed line. In case the means 50 are provided without senders, the ambient light conditions and sound conditions provide electromagnetic radiation and ultrasonic sound to such a degree that displacement of the rope over the limit position changes the observation of the receiving device to a detectable amount whereby it is possible to implement the device without a sender.

Alternative to the multiple sensing devices for receiving electromagnetic radiation or ultrasonic sound from said limit positions L1*a*,L2*a*;L1*b*,L2*b*; L1*c*,L2*c* described, said means 50 may comprise only one of said sensing devices for receiving ultrasonic sound or electromagnetic radiation from limit positions L1*a*,L2*a*,L1*b*,L2*b*;L1*c*,L2*c*, i.e. one sensing device for receiving ultrasonic sound or electromagnetic radiation from several limit positions, and a monitoring unit connected to the one sensing device and arranged to trigger said stopping if the ultrasonic sound or electromagnetic radiation received from one or more of said limit positions L1*a*,L2*a*;L1*b*,L2*b*,L1*c*,L2*c* meet(s) predetermined criteria, such as reaches a predetermined limit or changes in a predetermined way. In this case, the one or more sensing devices can be in the form of an ultrasonic sensing device, optical camera, scanner, a machine vision device or a pattern recognition device. In these cases, the sensing device can comprise one or more senders for sending ultrasonic sound or electromagnetic radiation towards said limit positions L1*a*,L2*a*,L1*b*,L2*b*;L1*c*,L2*c*, but this is not necessary.

Figure 8:
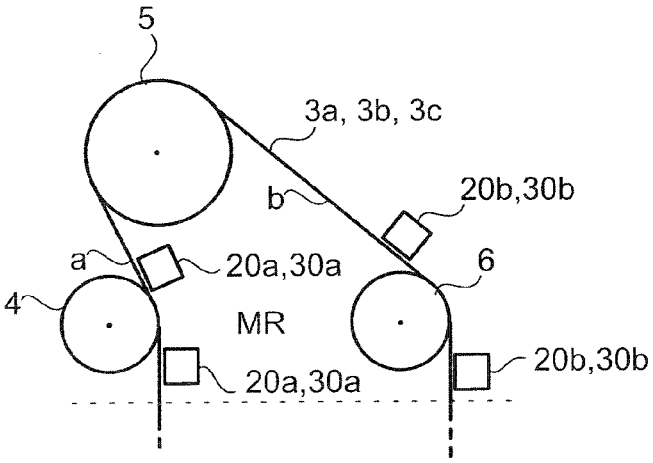
FIG. 8 illustrates further preferable details for the embodiment of FIG. 1.

FIG. 8 illustrates an embodiment wherein the rope monitoring arrangement comprises two first detectors 20*a*,30*a* configured to detect displacement of each of said first rope sections a in the axial direction of the wheels 4,5,6 away from a predefined zone and two second detectors 20*b*,30*b* configured to detect displacement of each of said second rope sections (b) in the axial direction of the wheels 4,5,6 away from a predefined zone (in particular over a limit position). Said two first detectors are focused to detect displacement of first rope sections before and after the first diverting wheel (as viewed in longitudinal of the ropes). Said two second detectors are focused to detect displacement of second rope sections before and after the second diverting wheel (as viewed in longitudinal of the ropes).

In the embodiments illustrated in Figures, the elevator comprises a non-driven cambered diverting wheel on both sides of the drive wheel 5, i.e. a first non-driven cambered diverting wheel 4 for diverting the first sections a as well as a second non-driven cambered diverting wheel 6 for diverting the second sections b. Thereby, rope sections on both sides of the drive wheel are diverted by a non-driven cambered diverting wheel. This is preferable for achieving advantages independently of drive direction. However, at least some of the advantages of the invention can be achieved if a non-driven cambered diverting wheel is only on one side of the drive wheel 5, e.g. if independence of drive direction is deemed unnecessary.

It is to be understood that the above description and the accompanying Figures are only intended to illustrate the present invention. It will be apparent to a person skilled in the art that the inventive concept can be implemented in various ways. The above-described embodiments of the invention may thus be modified or varied, without departing from the invention, as appreciated by those skilled in the art in light of the above teachings. It is therefore to be understood that the invention and its embodiments are not limited to the examples described above but may vary within the scope of the claims.

The invention claimed is:

1. An elevator, comprising:

a first elevator unit vertically movable in a hoistway, and a second elevator unit vertically movable in the hoistway, at least one of said elevator units being an elevator car;

one or more belt-shaped hoisting ropes interconnecting the first elevator unit and the second elevator unit; and rope wheels including a drive wheel for moving said one or more belt-shaped hoisting rope, wherein each of said one or more belt-shaped hoisting ropes passes around the drive wheel and comprises consecutively a first rope section extending between the drive wheel and the first elevator unit, and a second rope section extending between the drive wheel and the second elevator unit, wherein the rope wheels further include one or more non-driven cambered diverting wheels, each said first rope section being arranged to pass around a first non-driven, cambered diverting wheel, and wherein the elevator further comprises:

a rope monitoring arrangement configured to monitor displacement of each of said first rope sections in an axial direction of the rope wheels away from a predefined zone, and displacement of each of the second rope sections in the axial direction of the rope wheels away from a predefined zone, and wherein the elevator is configured to:

rotate the drive wheel in a first rotation direction such that each said first rope section runs from the drive wheel towards the first non-driven, cambered diverting wheel and each said second rope section runs from a second non-driven, cambered diverting wheel towards the drive wheel;

monitor displacement of each of the first rope sections in the axial direction of the rope wheels away from a predefined zone, and displacement of each of the second rope sections in the axial direction of the rope wheels away from a predefined zone, while the drive wheel is rotated in the first rotation direction;

stop rotation of the drive wheel in said first rotation direction when one or more of the first and second rope sections is displaced in the axial direction of the rope wheels away from the predefined zone; and thereafter to rotate the drive wheel in a second rotation direction opposite to said first rotation direction without further rotation of the drive wheel in said first rotation direction.

2. The elevator according to claim 1, wherein the elevator is configured to rotate the drive wheel in the second rotation direction only if one or more criteria are met.

3. The elevator according to claim 2, wherein said one or more criteria include at least one or both of the following:

none of the first rope sections is displaced in the axial direction of the rope wheels away from the predefined zone; and displacement of one or more of the second rope sections away from the predefined zone triggers stopping a rotation of the drive wheel in said first rotation direction.

4. The elevator according to claim 1, wherein each said second rope section is arranged to pass around the second non-driven, cambered diverting wheel.

5. The elevator according to claim 1, wherein the elevator is configured to continue rotating the drive wheel in the second rotation direction until the car is level with a landing, and wherein when the car is level with the landing, door(s) leading from the car are opened.

6. The elevator according to claim 1, wherein the rope monitoring arrangement is configured to monitor displacement of each of said first rope sections as defined with a first detector, and displacement of each of said second rope sections as defined with a second detector.

7. The elevator according to claim 1, wherein said rope monitoring arrangement comprises:

at least one first detector configured to detect displacement of each of said first rope sections in the axial direction of the rope wheels away from a predefined zone; and at least one second detector configured to detect displacement of each of said second rope sections in the axial direction of the rope wheels away from a predefined zone.

8. The elevator according to claim 1, wherein each said first detector is configured to detect displacement of each of said first rope sections in an axial direction of the wheels over a first limit position or over a second limit position between which first and second limit position the first rope section is disposed, and each said second detector is configured to detect displacement of each of said second rope sections in an axial direction of the rope wheels over a first limit position or over a second limit position, between which first and second limit position the second rope section is disposed.

9. The elevator according to claim 1, wherein each predefined zone is delimited by a first and second limit position.

10. The elevator according to claim 1, wherein displacement of one or more of said first rope sections in the axial direction of the rope wheels away from the predefined zone, or displacement of one or more of said second rope sections in the axial direction of the rope wheels away from the predefined zone, is arranged to trigger the elevator to stop the rotation of the drive wheel.

11. A method for controlling an elevator which elevator comprises:

a first elevator unit vertically movable in a hoistway, and a second elevator unit vertically movable in a hoistway, at least one of said elevator units being an elevator car;

one or more belt-shaped hoisting ropes interconnecting the first elevator unit and the second elevator unit; and rope wheels including a drive wheel for moving said one or more belt-shaped hoisting ropes, wherein each of said one or more belt-shaped hoisting ropes passes around the drive wheel and comprises consecutively a first rope section extending between the drive wheel and the first elevator unit, and a second rope section extending between the drive wheel and the second elevator unit, wherein the rope wheels further include one or more non-driven, cambered diverting wheels, each said first rope section being arranged to pass around a first non-driven, cambered diverting wheel, and wherein the elevator further comprises:

a rope monitoring arrangement, the method comprising the steps of:

rotating the drive wheel in a first rotation direction such that each said first rope section runs from the drive wheel towards the first non-driven, cambered diverting wheel;

monitoring displacement of each said first rope section in an axial direction of the rope wheels away from a predefined zone, as well as displacement of each said second rope section in the axial direction of the rope wheels away from a predefined zone, while the drive wheel is rotated in said first rotation direction;

stopping the rotation of the drive wheel in said first rotation direction when one or more of the first and second rope sections is displaced in the axial direction of the rope wheels away from the predefined zone; and after stopping, rotating the drive wheel in a second rotation direction opposite the first rotation direction without further rotation of the drive wheel in said first rotation direction.

12. The method according to claim 11, wherein the method further comprises rotating the drive wheel in a second rotation direction only if one or more criteria are met.

13. The method according to claim 12, wherein said one or more criteria include at least one or both of the following:

none of the first rope sections is displaced in the axial direction of the rope wheels away from the predefined zone; and displacement of one or more of the second rope sections away from the predefined zone triggers stopping a rotation of the drive wheel in said first rotation direction.

14. The method according to claim 11, wherein said rotating the drive wheel in the second rotation direction is continued until the car is level with a landing, and the method further comprises opening door(s) leading from car to said landing when the car is level with said landing.

15. The method according to claim 11, wherein the displacement of each of said first rope sections is monitored as defined with a first detector, and displacement of each of said second rope sections is monitored as defined with a second detector.

* * * * *